US009517554B1

(12) United States Patent
Marin et al.

(10) Patent No.: US 9,517,554 B1
(45) Date of Patent: Dec. 13, 2016

(54) HAMMER WITH A TELESCOPICALLY MAGNETIC ROD FOR THE RECOVERY OF METALLIC OBJECTS

(71) Applicants: Leonardo Marin, Miami, FL (US); Jacquelin Marin, Miami, FL (US)

(72) Inventors: Leonardo Marin, Miami, FL (US); Jacquelin Marin, Miami, FL (US)

(73) Assignee: Leonardo Marin, Miami, FL (US)

( * ) Notice: Subject to any disclaimer, the term of this patent is extended or adjusted under 35 U.S.C. 154(b) by 217 days.

(21) Appl. No.: 14/498,705

(22) Filed: Sep. 26, 2014

(51) Int. Cl.
*B25F 1/00* (2006.01)
*B25D 1/06* (2006.01)
*B25G 1/08* (2006.01)

(52) U.S. Cl.
CPC ..... *B25F 1/006* (2013.01); *B25D 1/06* (2013.01); *B25G 1/08* (2013.01)

(58) Field of Classification Search
CPC ..... B25D 1/06; B25G 1/04; B25G 1/08; B25F 1/006
USPC ..... 81/26, 490, 492
See application file for complete search history.

(56) References Cited

U.S. PATENT DOCUMENTS 792,719 A * 6/1905 Molkenthin ..... B23D 51/01 33/809
1,109,507 A * 9/1914 Bostock ..... B25D 1/04 7/143
1,934,706 A * 11/1933 Green ..... B25D 1/04 254/26 R
3,228,720 A * 1/1966 Jordan ..... B25D 1/06 294/65.5
3,425,468 A * 2/1969 Soucy ..... B25D 1/06 294/65.5
4,039,012 A * 8/1977 Cook ..... B25D 1/02 473/333
5,174,178 A * 12/1992 Disston, Jr. ..... B25G 1/085 81/177.4
5,896,606 A * 4/1999 Huang ..... B25B 9/00 7/165
5,901,622 A * 5/1999 Sweeny ..... B25B 9/00 7/165
6,014,785 A * 1/2000 Punch et al. ..... A46B 15/0055 15/111
6,088,862 A * 7/2000 Bulcock ..... B25D 1/00 7/146
6,105,190 A * 8/2000 Shiao ..... B25B 9/00 7/165
6,260,453 B1 * 7/2001 Anderson et al. .... B25B 15/008 7/165
6,260,980 B1 * 7/2001 Ping ..... B25B 9/00 294/65.5
6,283,449 B1 * 9/2001 Hu ..... B25D 1/045 254/26 R
6,959,465 B1 * 11/2005 Foster ..... B25D 1/06 7/143

(Continued)

*Primary Examiner* — David B Thomas
(74) *Attorney, Agent, or Firm* — Christian Sanchelion

(57) ABSTRACT

A hammer having a hallowed handle to house a telescopic rod that uses a magnetic member to retrieve metal-based objects that may have fallen away from a user or fallen into a hard to reach space. This improvement can be used with hammers having nail-extracting claws opposite their face or peen-style hammers. In an alternate embodiment, the improvement can be used with claws that have nail-extracting slits at their distal ends to extract nails that are in locations too difficult to reach with conventional claws.

3 Claims, 5 Drawing Sheets

(56) References Cited

U.S. PATENT DOCUMENTS

| | | | | |
|---|---|---|---|---|
| 7,013,516 | B1 * | 3/2006 | Peters | B25D 1/02 7/146 |
| 7,617,749 | B2 * | 11/2009 | Kelland | B25D 1/02 81/23 |
| D648,201 | S * | 11/2011 | Cortez-Sanchez | D8/75 |
| 8,162,363 | B2 * | 4/2012 | Wang | B25B 11/002 294/210 |
| 8,210,584 | B2 * | 7/2012 | Hiltz | B25D 1/00 294/175 |
| 2003/0233916 | A1 * | 12/2003 | Kozak | B25B 9/00 81/439 |
| 2008/0110298 | A1 * | 5/2008 | Monk | B67B 7/16 81/3.08 |

* cited by examiner

HAMMER WITH A TELESCOPICALLY MAGNETIC ROD FOR THE RECOVERY OF METALLIC OBJECTS

BACKGROUND OF THE INVENTION

1. Field of the Invention

The present invention relates to hammers and, more particularly, to a hammer having a telescopic rod using magnetic means to extract or retrieve metal-based objects.

2. Description of the Related Art

Several designs for hammers have been designed in the past. None of them, however, include a hammer having a telescopic rod with a magnetic member used to extract or retrieve metallic objects.

Applicant believes that a related reference corresponds to U.S. Pat. No. 6,283,449 issued to Hu, Bobby on Sep. 4, 2001 for a hammer with nail digging function. The Hu reference teaches of a hammer that includes a pair of claws having nail extracting slits for extracting nails on each or both claws. However, it differs from the present invention because the Hu reference does not teach or suggest of a hammer having a telescopic rod housed within the hammer's handle that can be telescopically extended with a magnetic member on its distal end to readily retrieve metallic objects that have fallen or are located in remote areas from the user.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a hammer that can easily retrieve metal-based objects that have fallen away from a user or are located away from a user.

It is another object of this invention to provide a hammer with a claw having nail extracting slits on at least one claw that are used to remove nails that cannot be easily extracted through the conventional use of a hammer's claw.

It is still another object of the present invention to provide a telescopic rod that can be housed within the hammer's handle to maintain the ergonomics of the hammer while being able to be significantly extended to pick up hard to reach objects.

It is another object of the invention to provide a cap that secures the telescopic rod within the hammer's handle that can hinge on the hammer's handle so that it cannot be dropped or misplaced.

It is yet another object of this invention to provide such a hammer that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
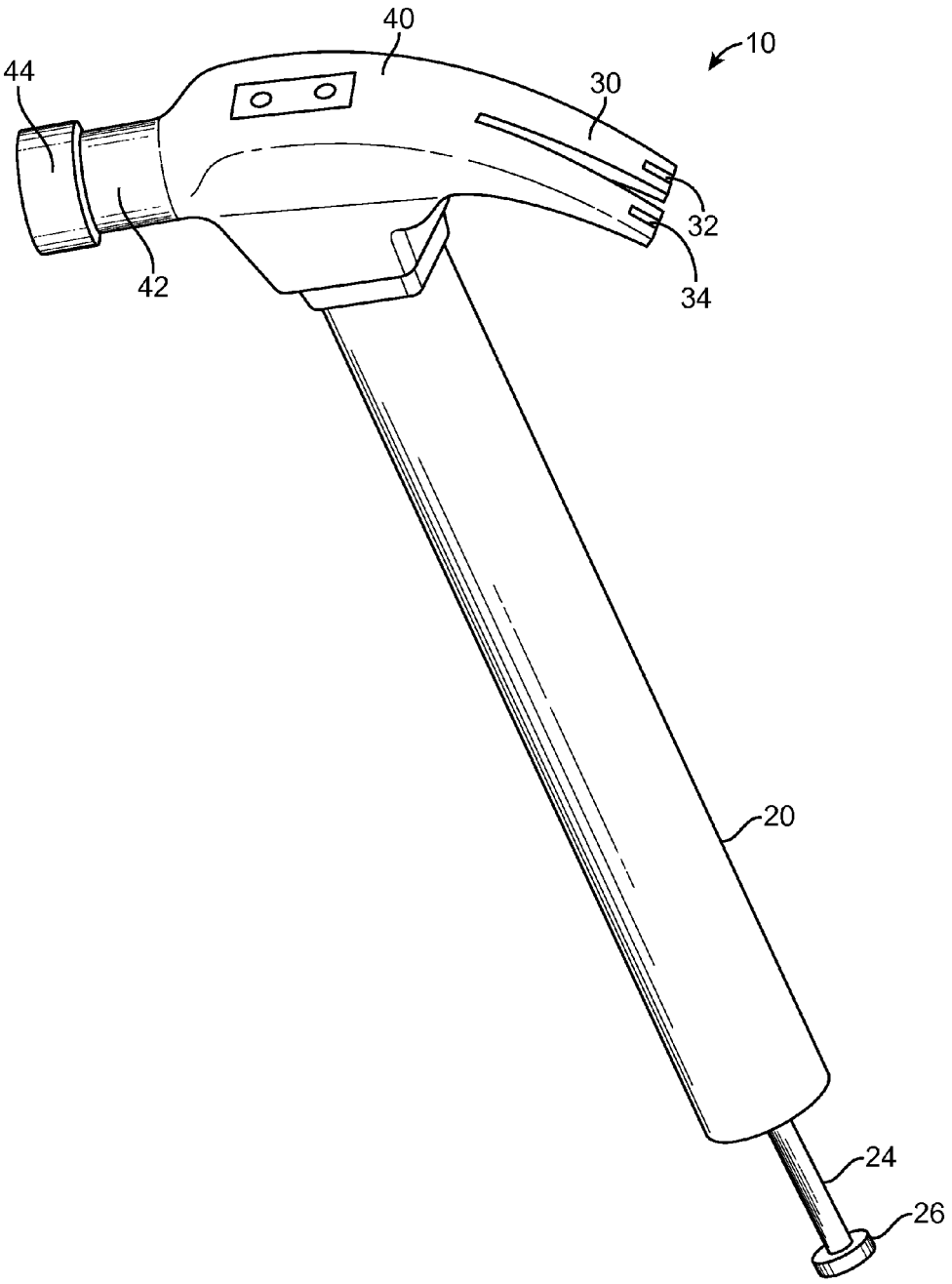
FIG. 1 shows an isometric view of the present invention wherein nail extracting slits 32; 34 can be used in combination with telescopic rod 24 having magnetic portion 26 at its distal end.

Referring now to the drawings, where the present invention is generally referred to with numeral 10, it can be observed that it basically includes handle 20, head 40, neck 42, face 44, claws 30, telescopic rod 24, and magnetic portion 26.

Figure 2:
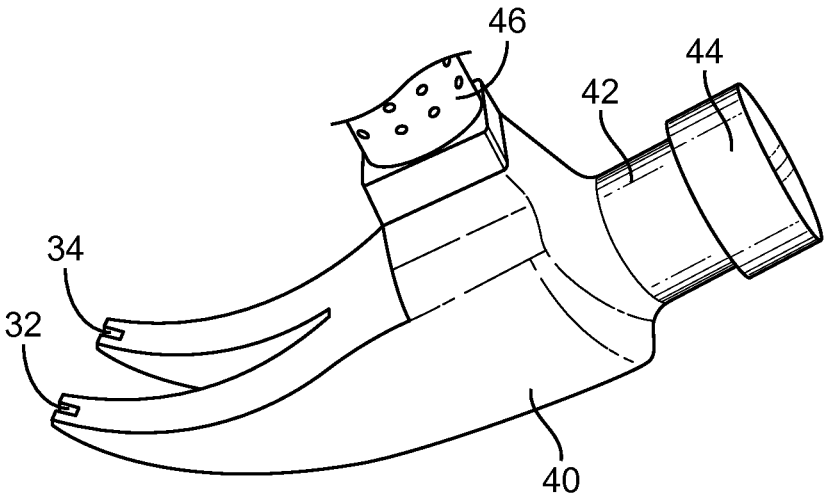
FIG. 2 is an enlarged partial view of the present invention wherein the bottom of claws 30 are shown having nail extracting slits 32; 34. In this embodiment, grip 46 is shown.

Handle 20 is partially hollowed to be able to cooperatively house telescopic rod 24. Telescopic rod 24 has magnetic portion 26 mounted to its distal end, as shown in FIG. 1. Magnetic portion 26 is used to conveniently pick up metal-based objects such as nails and screws that have fallen away from a user or that need to be retrieved by a user. In one embodiment, shown in FIGS. 1 and 2, telescopic rod 24 and magnetic portion 26 is used with claws 30 having nail-extracting slits 32; 34 at their distal ends. Nail-extracting slits 32; 34 are used to extract nails or similar fastening members that are located in areas that cannot be reached by conventional claws.

Figure 3:
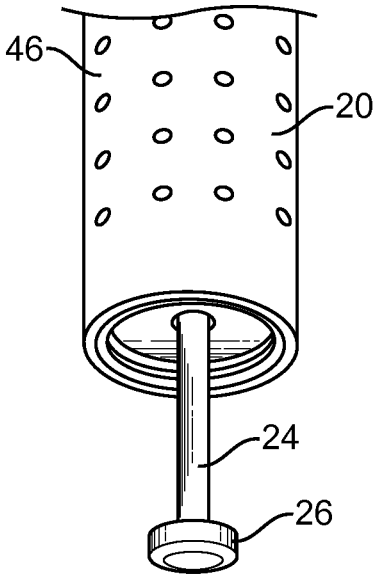
FIG. 3 shows an enlarged partial view of the bottom of handle 20 having telescopic rod 24 partially extended from the base of handle 20. Magnetic portion 26 is also shown at the distal end of telescopic rod 24.
Figure 4:
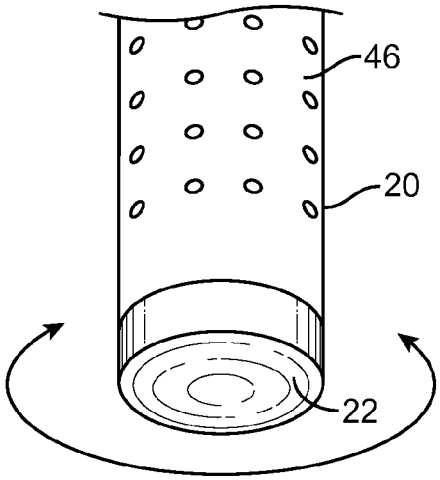
FIG. 4 illustrates an enlarged partial view of the bottom of handle 20 wherein cap 22 can be seen screwed into the bottom of handle 20 thereby securing telescopic rod within handle 20.

As shown in FIG. 3, telescopic rod 24 extends from base of handle 20 a predetermined distance depending on the length of telescopic rod 24. Telescopic rod 26 has enough tension between its telescopic members so as to require a user to pull telescopic rod 26 to achieve the length necessary to receive the metal-based object. In an alternate embodiment, shown in FIG. 3, gripping material 46 can be applied to handle 20. As shown in FIG. 4, cap 22 can be removably mounted to the bottom of handle 20 to secure telescopic rod 24 within the housing of handle 20.

Figure 5:
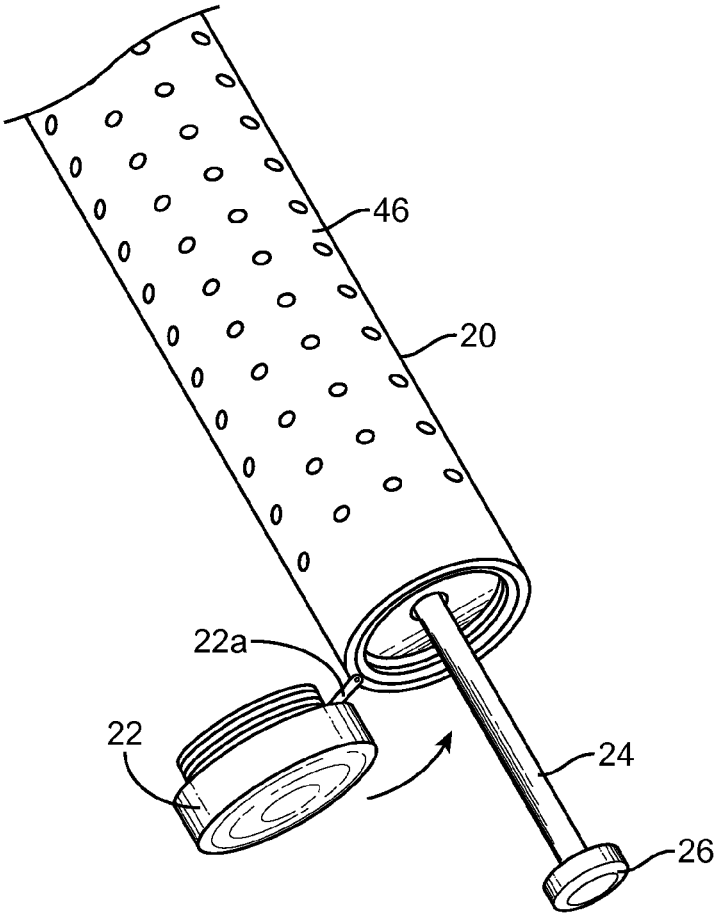
FIG. 5 is a representation of a partial view of the bottom of handle 20 wherein telescopic rod 24 having magnetic portion 26 is partially extended and cap 22 is secured to the bottom of handle 20 using hinge 22*a*.
Figure 6:
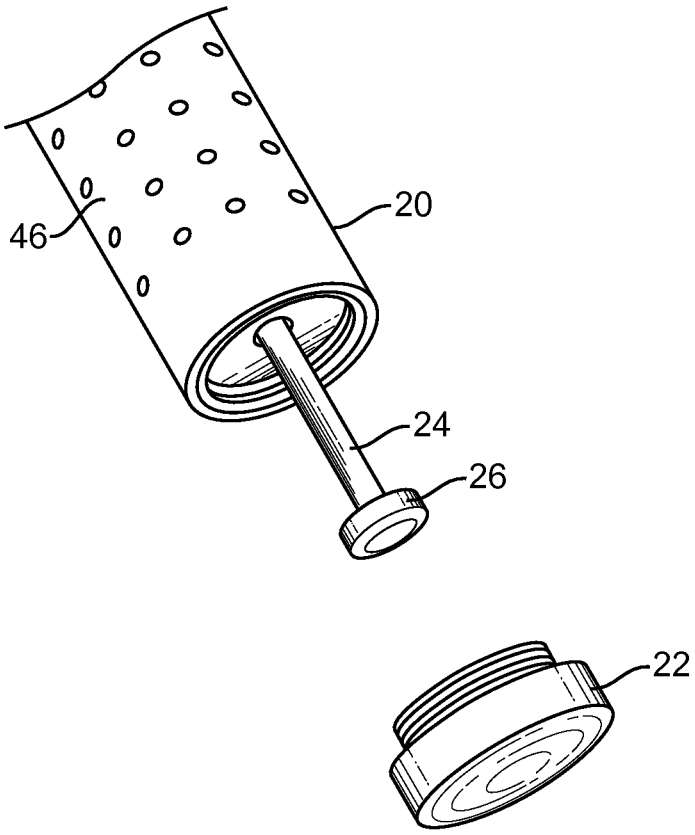
FIG. 6 is an enlarged partial view of an alternate embodiment of the present invention wherein the bottom of handle 20 has telescopic rod 24 partially extending from the bottom of handle 20 and cap 22 is shown without hinge 22*a*.
Figure 7:
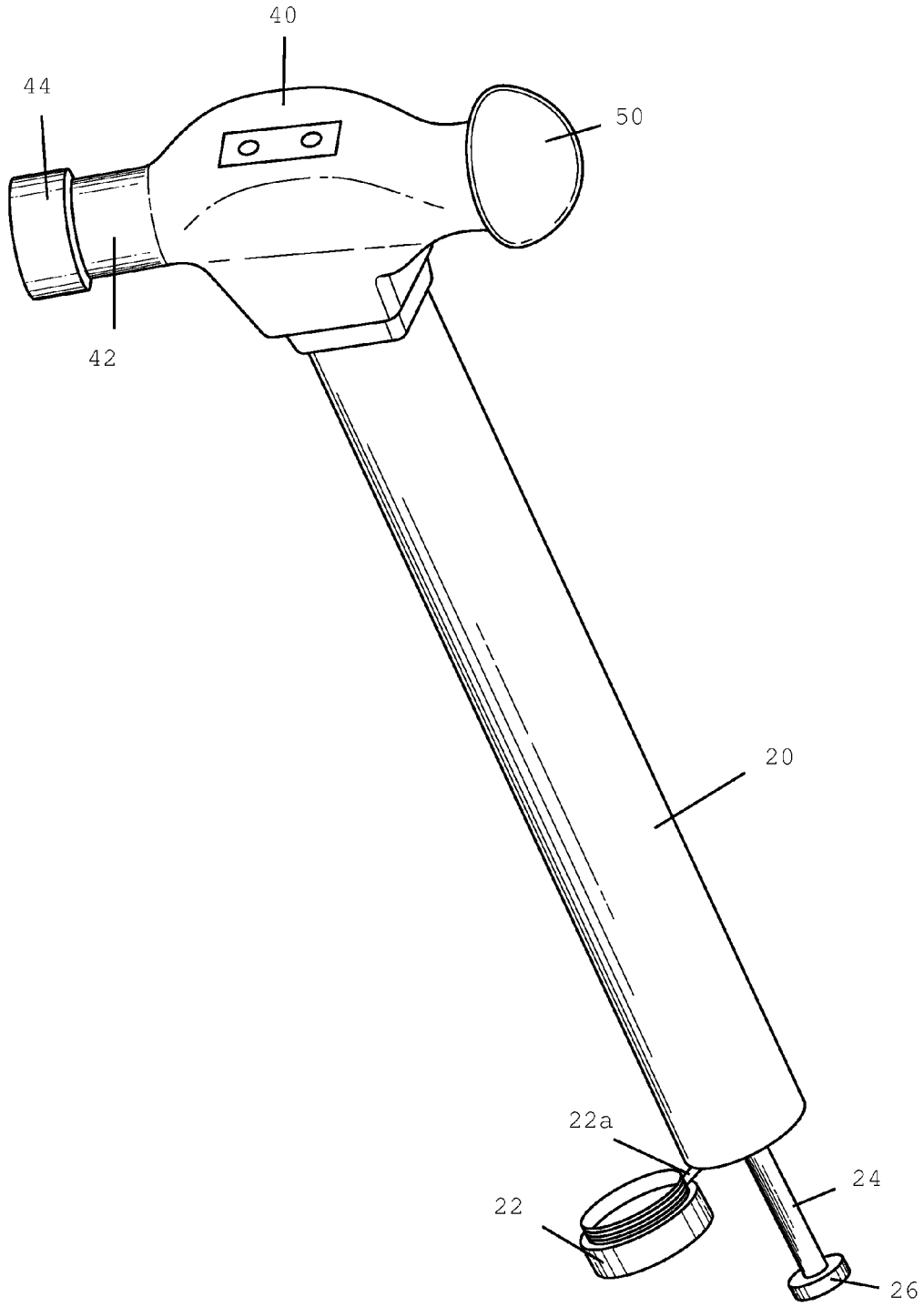
FIG. 7 is an alternate embodiment of the present invention wherein a peen-style hammer having peen 50 opposite face 44 is used with telescopic rod 24 having magnetic portion 26 extending from the bottom of handle 20.

In an alternate embodiment shown in FIG. 5, cap 22 can be mounted to the bottom of handle 20 using hinge 22*a* that provides the convenience of maintaining cap 22 on handle 20 at all times so that it cannot be misplaced or dropped. In an alternate embodiment shown in FIG. 7, telescopic rod 24 can be used with a peen-style hammer having peen 50 at the end opposite face 44 instead of claws 30. In another alternate embodiment magnetic portion 26 can include a light source.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A hammer including:

a partially hollowed handle housing a telescopic rod that is extended a predetermined distance from the base of said handle, said telescopic rod having a magnetic member mounted to its distal end, a head mounted to said handle having a face on one end and at least one claw at its opposite end, a nail extracting slit on at least one said one claw, a cap at the base of said handle that secures said telescopic rod within said handle housing, said cap is hingedly mounted to the base of said handle and said magnetic member includes a light source.

2. The hammer set forth in claim 1 including a peen opposite to said face.

3. The hammer set forth in claim 1 wherein the surface of said handle has a gripping material applied.

* * * * *